US009809948B2

(12) United States Patent
Imaizumi et al.

(10) Patent No.: US 9,809,948 B2
(45) **Date of Patent: *Nov. 7, 2017**

(54) WORK VEHICLE CONTROL METHOD, WORK VEHICLE CONTROL DEVICE, AND WORK VEHICLE

(71) Applicant: Komatsu Ltd., Tokyo (JP)

(72) Inventors: Masaaki Imaizumi, Mooka (JP); Minoru Wada, Mooka (JP); Yoshiaki Saito, Kawaguchi (JP)

(73) Assignee: Komatsu Ltd., Tokyo (JP)

( * ) Notice: Subject to any disclaimer, the term of this patent is extended or adjusted under 35 U.S.C. 154(b) by 439 days.

This patent is subject to a terminal disclaimer.

(21) Appl. No.: 14/385,603

(22) PCT Filed: May 30, 2014

(86) PCT No.: PCT/JP2014/064540

§ 371 (c)(1),
(2) Date: Sep. 16, 2014

(87) PCT Pub. No.: WO2015/102059

PCT Pub. Date: Jul. 9, 2015

(65) Prior Publication Data

US 2016/0265185 A1 Sep. 15, 2016

(51) Int. Cl.
*G06F 7/70* (2006.01)
*E02F 3/43* (2006.01)
(Continued)

(52) U.S. Cl.
CPC ..... *E02F 3/434* (2013.01); *E02F 3/432* (2013.01); *E02F 9/2029* (2013.01);
(Continued)

(58) Field of Classification Search
CPC ..... E02F 3/434; E02F 9/2214; E02F 9/2282; E02F 9/2203; E02F 9/2296
(Continued)

(56) References Cited

U.S. PATENT DOCUMENTS 6,275,757 B1 * 8/2001 Watanabe ..... E02F 3/437 172/6
2010/0312437 A1 12/2010 Saito
(Continued)

FOREIGN PATENT DOCUMENTS

CN 101946045 A 1/2011
CN 102362035 A 2/2012
(Continued)

OTHER PUBLICATIONS

International Search Report and Written Opinion dated Aug. 19, 2014, issued for PCT/JP2014/064540.

*Primary Examiner* — Gertrude Arthur Jeanglaude
(74) *Attorney, Agent, or Firm* — Locke Lord LLP

(57) ABSTRACT

In controlling a work vehicle including a boom supported by a vehicle body and configured to turn, and a bucket supported by a side, away from the vehicle body, of the boom and configured to turn according to an operation of an actuator, an operation amount for raising the boom or a rising speed of the boom, and an operable amount that the actuator is able to operate before the bucket reaches a stop position on the dump side based on the posture of the boom and the posture of the bucket, are obtained, and an operation amount of the actuator for causing the bucket to tilt is changed based on the operation amount for raising the boom or the rising speed of the boom to thereby cause the bucket to tilt according to the operable amount.

5 Claims, 9 Drawing Sheets

(51) Int. Cl.

| | |
|---|---|
| ***E02F 9/22*** | (2006.01) |
| ***E02F 9/20*** | (2006.01) |
| *E02F 3/34* | (2006.01) |
| *E02F 3/342* | (2006.01) |

(52) U.S. Cl.
CPC ..... *E02F 9/2296* (2013.01); *E02F 3/34* (2013.01); *E02F 3/342* (2013.01); *E02F 3/3417* (2013.01)

(58) Field of Classification Search
USPC ..... 701/49, 36, 50; 172/4.5, 9
See application file for complete search history.

(56) References Cited

U.S. PATENT DOCUMENTS

| | | | |
|---|---|---|---|
| 2012/0024146 | A1 | 2/2012 | Saito |
| 2014/0129093 | A1 | 5/2014 | Shirao et al. |

FOREIGN PATENT DOCUMENTS

| | | | |
|---|---|---|---|
| EP | 2251494 | A1 | 11/2010 |
| EP | 2412875 | A1 | 2/2012 |
| JP | 58-218524 | A | 12/1983 |
| JP | 2010-110386 | A | 5/2010 |
| JP | 2014-055439 | A | 3/2014 |
| WO | WO-2010/110386 | A1 | 9/2010 |

* cited by examiner

FIG.5

TBA

| SCR | | 0 | -20 | -40 | -60 | -80 | -100 | -120 |
|---|---|---|---|---|---|---|---|---|
| BVC | 0% (a) | 15 | 40 | 60 | 80 | 90 | 100 | 100 |
| | 50% (b) | 15 | 20 | 40 | 60 | 80 | 90 | 100 |
| | 100% (c) | 15 | 15 | 15 | 40 | 70 | 80 | 100 |

LQ

FIG.6

TBB

| SCR | | 0 | -20 | -40 | -60 | -80 | -100 | -120 |
|---|---|---|---|---|---|---|---|---|
| BVC | 0% (d) | 100 | 100 | 100 | 100 | 100 | 100 | 100 |
| | 50% (b) | 15 | 20 | 40 | 60 | 80 | 90 | 100 |
| | 100% (c) | 15 | 15 | 15 | 40 | 70 | 80 | 100 |

LQ

TBC

| SCR | | 5 | 0 | -10 | -20 | -30 | -40 | -50 |
|---|---|---|---|---|---|---|---|---|
| BVC | 0% (e) | -20 | 0 | 0 | 0 | 0 | 0 | 0 |
| | 50% (f) | -20 | -10 | 0 | 0 | 0 | 0 | 0 |
| | 100% (g) | -20 | -10 | -10 | 0 | 0 | 0 | 0 |

CC

WORK VEHICLE CONTROL METHOD, WORK VEHICLE CONTROL DEVICE, AND WORK VEHICLE

FIELD

The present invention relates to a work vehicle which performs excavation work.

BACKGROUND

Work vehicles equipped with a work machine used to load dirt, crushed stones, or the like onto a dump truck or the like have been known. As such a work vehicle, there is a wheel loader. A wheel loader is a vehicle having a bucket for performing excavation work, which works by traveling with tires. For example, Patent Literature 1 discloses causing a bucket to perform tilting automatically during rising of a boom.

CITATION LIST

Patent Literature

Patent Literature 1: WO 2010/110386 A

SUMMARY

Technical Problem

If a bucket is caused to perform tilting automatically during rising of the boom, the bucket performs tilting even when an operator does not perform an operation to tilt the bucket, which may give the operator a sense of discomfort.

An object of the present invention is to reduce a sense of discomfort given to the operator when the bucket is caused to tilt automatically during rising of the boom.

Solution to Problem

According to the present invention, a work vehicle control method comprises, in controlling a work vehicle including a boom supported by a vehicle body and configured to turn; and a bucket supported by a side, away from the vehicle body, of the boom and configured to turn according to an operation of an actuator: obtaining an operation amount for raising the boom or a rising speed of the boom and an operable amount that the actuator is able to operate before the bucket reaches a stop position on a dump side, the operable amount being obtained based on a posture of the boom and a posture of the bucket; and causing the bucket to perform tilting by operating the actuator from a position where the operable amount is large such that the operable amount becomes larger as the operation amount for raising the boom is larger or the rising speed of the boom is higher.

According to the present invention, a work vehicle control device which controls a work vehicle including a boom supported by a vehicle body and configured to turn; and a bucket supported by a side, away from the vehicle body, of the boom, and configured to turn according to an operation of an actuator, wherein the work vehicle control device obtains an operation amount for raising the boom or a rising speed of the boom, and an operable amount that the actuator is able to operate before the bucket reaches a stop position on a dump side, the operable amount being obtained based on a posture of the boom and a posture of the bucket, and the work vehicle control device causes the bucket to perform tilting by operating the actuator from a position where the operable amount is large such that the operable amount becomes larger as the operation amount for raising the boom is larger or the rising speed of the boom is higher.

According to the present invention, a work vehicle comprises: a boom supported by a vehicle body and configured to turn; a bucket supported by a side, away from the vehicle body, of the boom, and configured to turn according to an operation of an actuator; and the work vehicle control device.

It is preferable to cause the bucket to perform tilting according to the operable amount in the case where the boom is raised and a device for operating the bucket is in a neutral state.

The present invention is able to reduce a sense of discomfort given to the operator when the bucket is caused to tilt automatically during rising of the boom.

BRIEF DESCRIPTION OF DRAWINGS

FIG. 5 is a drawing illustrating an example of a first table for control to be used for control at the time of dumping in a work vehicle control method according to the present embodiment.

FIG. 6 is a drawing illustrating an example of a second table for control to be used for control at the time of dumping in the work vehicle control method according to the present embodiment.

DESCRIPTION OF EMBODIMENTS

A mode for carrying out the present invention (embodiment) will be described in detail with reference to the drawings.

<Wheel Loader>

Figure 1:
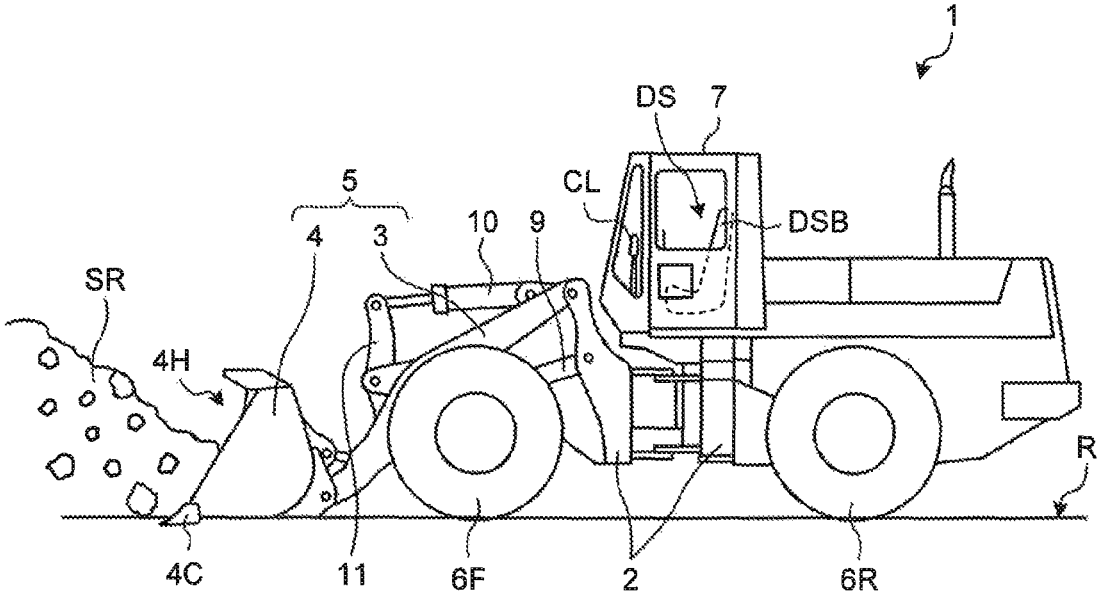
FIG. 1 is a diagram illustrating a work vehicle according to the present embodiment.

FIG. 1 is a diagram illustrating a work vehicle according to the present embodiment. In the present embodiment, as an example of a work vehicle, description will be given on a wheel loader 1 which loads crushed stones, dirt generated when excavating crushed stones, rocks, or the like onto a dump truck or the like as a delivery vehicle.

The wheel loader 1 includes a vehicle body 2, a work machine 5 equipped with a boom 3 and a bucket 4, front wheels 6F and rear wheels 6R, a driver's cabin 7, a boom cylinder 9 corresponding to an actuator, and a bucket cylinder 10 corresponding to an actuator. On the vehicle body 2, the work machine 5, the front wheels 6F and the rear wheels 6R, and the driver's cabin 7 are mounted. In the driver's cabin 7, a driver's seat DS and a control lever CL are provided. A direction from the backrest DSB of the driver's seat DS to the control lever CL is called front, and a direction from the control lever CL to the backrest DSB is called back. Right and left of the wheel loader 1 is determined with reference to the front.

The front wheels 6F and the rear wheels 6R are grounded on a road surface R. The grounded side of the front wheels 6F and the rear wheels 6R is called downward, and a direction separating from the grounded side of the front wheels 6F and the rear wheels 6R is called upward. With rotation of the front wheels 6F and the rear wheels 6R, the wheel loader 1 travels. Steering of the wheel loader 1 is realized by bending the vehicle body 2 between the front wheels 6F and the rear wheels 6R.

The work machine 5 is disposed on the front part of the vehicle body 2. The boom 3 is supported on the front side of the vehicle body 2 and extends toward the front. The boom 3 is supported by the vehicle body 2 and turns. The bucket 4 has an opening 4H and a claw 4C. The bucket 4 excavates the target with the claw 4C which scoops out dirt, crushed stones, or the like. Dirt, crushed stones, or the like, scooped out by the claw 4C is called excavated material SR as appropriate. The excavated material SR scooped out by the claw 4C enters from the opening 4H to the inside of the bucket 4. The bucket 4 turns by being supported on a side of the boom 3 opposite to the vehicle body 2 side, that is, a side away from the vehicle body 2.

The boom cylinder 9, working as a boom driving device, is disposed between the vehicle body 2 and the boom 3. The boom 3 turns about the supporting part on the vehicle body 2 side according to expansion and contraction of the boom cylinder 9. The boom driving device which allows the boom 3 to turn is not limited to the boom cylinder 9. For example, the boom driving device may be an electric motor provided to the root of the boom 3. As described above, the boom driving device is an actuator which allows the boom 3 to turn.

The bucket cylinder 10 is configured such that one end thereof is attached to the vehicle body 2 and is supported, and the other end thereof is attached to one end of a bell crank 11. The other end of the bell crank 11 is linked to the bucket 4. The bucket 4 turns about the part supported by the boom 3 according to expansion and contraction of the bucket cylinder 10. The device which allows the bucket 4 to turn is not limited to the bucket cylinder 10.

The control lever CL controls expansion and contraction of the boom cylinder 9 and the bucket cylinder 10. When an operator on the driver's cabin 7 operates the control lever CL, at least one of the boom cylinder 9 and the bucket cylinder 10 expands or contracts. Then, at least one of the boom 3 and the bucket 4 turns. In this way, the boom 3 and the bucket 4 are operated when the operator operates the control lever CL.

<Control System of Work Machine 5>

Figure 2:
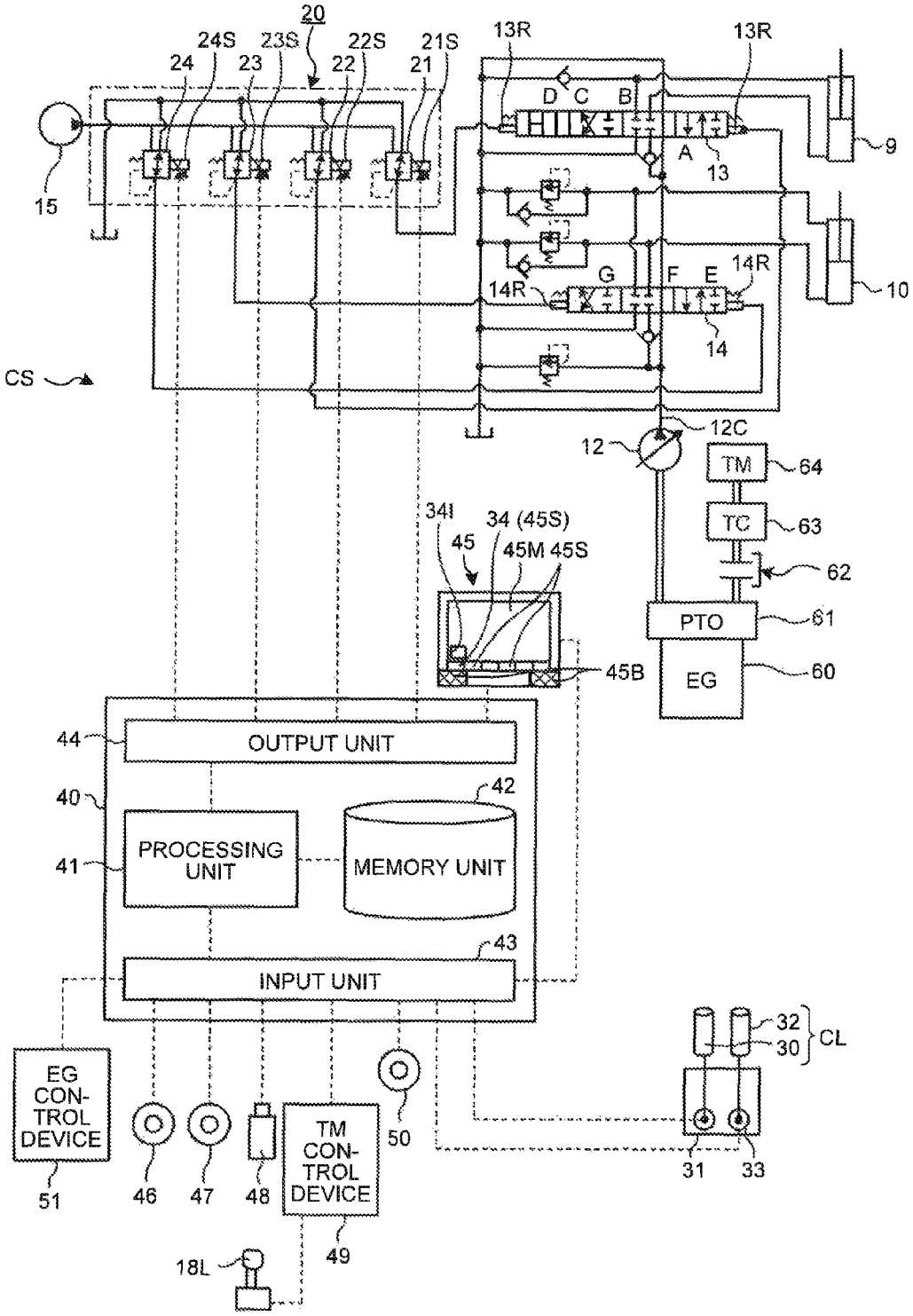
FIG. 2 is a diagram illustrating a control system for controlling operation of a work machine.

FIG. 2 is a diagram illustrating a control system for controlling operation of the work machine 5. A control system CS for controlling operation of the work machine 5 illustrated in FIG. 1, that is, operation of the boom 3 and the bucket 4, includes a work machine hydraulic pump 12, a boom operation valve 13, a bucket operation valve 14, a pilot pump 15, a discharge circuit 12C, an electromagnetic proportional control valve 20, a control device 40, a TM (transmission) control device 49, and an EG (engine) control device 51.

The work machine hydraulic pump 12 is driven by an engine (EG) 60 as a power generator mounted on the wheel loader 1. The engine 60 is an internal combustion engine, and in the present embodiment, it is a diesel engine. The type of the engine 60 is not limited to a diesel engine. The power of the engine 60 is input to a PTO (Power Take Off) 61, and then output to the work machine hydraulic pump 12 and to a clutch 62 as a power transmission mechanism. With this structure, the work machine hydraulic pump 12 is driven by the engine 60 via the PTO 61, and discharges hydraulic oil.

The input side of the clutch 62 is connected with the engine 60, and the output side of the clutch 62 is connected with a torque converter (TC) 63. The output side of the torque converter 63 is connected with a transmission (TM) 64. With this structure, the power of the engine 60 is transmitted to the transmission 64 via the PTO 61, the clutch 62, and the torque converter 63. The transmission 64 transmits the power of the engine 60, transmitted from the PTO 61, to the front wheels 6F and the rear wheels 6R shown in FIG. 1, and drives them. The wheel loader 1 and the vehicle body 2 travel with the front wheel 6F and the rear wheel 6R being driven by the output of the engine 60. The front wheels 6F and the rear wheels 6R work as drive wheels of the wheel loader 1.

The discharge port, from which the work machine hydraulic pump 12 discharges hydraulic oil, is connected with the discharge circuit 12C working as an oil passage through which the hydraulic oil passes. The discharge circuit 12C is connected with the boom operation valve 13 and the bucket operation valve 14. Both the boom operation valve 13 and the bucket operation valve 14 are hydraulic pilot type operation valves. The boom operation valve 13 and the bucket operation valve 14 are connected with the boom cylinder 9 and the bucket cylinder 10, respectively. The work machine hydraulic pump 12, the boom operation valve 13, the bucket operation valve 14, and the discharge circuit 12C constitute a tandem hydraulic circuit.

The boom operation valve 13 is a four-way selector valve having a position A, a position B, a position C, and a position D. The boom operation valve 13 is configured such that the boom 3 moves up at the position A, the boom 3 is neutral and maintains the position at the position B, the boom 3 moves down at the position C, and the boom 3 floats at the position D. The bucket operation valve 14 is a three-way selector value having a position E, a position F, and a position G. The bucket operation valve 14 is configured such that the bucket 4 performs tilting at the position E, the bucket 4 is neutral and maintains the position at the position F, and the bucket 4 performs dumping at the position G.

The tilting of the bucket 4 is an operation that the opening 4H and the claw 4C of the bucket 4 shown in FIG. 1 turn toward the driver's cabin 7 to thereby be tilted. The dumping of the bucket 4 is an operation that the opening 4H and the claw 4C of the bucket 4 turn away from the driver's cabin 7, in opposite to the tilting, to thereby be tilted.

Each of the pilot pressure receiving parts of the boom operation valve 13 and the bucket operation valve 14 is connected with the pilot pump 15 via the electromagnetic proportional control valve 20. The pilot pump 15 is connected with the PTO 61, and is driven by the engine 60. The pilot pump 15 supplies hydraulic oil of a predetermined pressure (pilot pressure) to a pilot pressure receiving part 13R of the boom operation valve 13 and a pilot pressure receiving part 14R of the bucket operation valve 14 via the electromagnetic proportional control valve 20.

The electromagnetic proportional control valve 20 includes a boom lowering electromagnetic proportional control valve 21, a boom raising electromagnetic proportional control valve 22, a bucket dump electromagnetic proportional control valve 23, and a bucket tilt electromagnetic proportional control valve 24. The boom lowering electromagnetic proportional control valve 21 and the boom raising electromagnetic proportional control valve 22 are connected with the respective pilot pressure receiving parts 13R and 13R of the boom operation valve 13. The bucket dump electromagnetic proportional control valve 23 and the bucket tilt electromagnetic proportional control valve 24 are connected with the respective pilot pressure receiving part 14R and 14R of the bucket operation valve 14. To a solenoid command part 21S of the boom lowering electromagnetic proportional control valve 21, a solenoid command part 22S of the boom raising electromagnetic proportional control valve 22, a solenoid command part 23S of the bucket dump electromagnetic proportional control valve 23, and a solenoid command part 24S of the bucket tilt electromagnetic proportional control valve 24, respective command signals from the control device 40 are input.

The boom lowering electromagnetic proportional control valve 21, the boom raising electromagnetic proportional control valve 22, the boom operation valve 13, and the boom cylinder 9 have a function as a boom driving part to turn (move up and down) the boom 3. The bucket dump electromagnetic proportional control valve 23, the bucket tilt electromagnetic proportional control valve 24, the bucket operation valve 14, and the bucket cylinder 10 have a function as a bucket driving part to turn the bucket (perform tilting or dumping).

The control device 40 includes a processing unit 41 such as a CPU (Central Processing Unit), a memory unit 42 such as a ROM (Read Only Memory), an input unit 43, and an output unit 44. The processing unit 41 sequentially executes various types of commands described in a computer program to thereby control operation of the work machine 5. The processing unit 41 is electrically connected with the memory unit 42, the input unit 43, and the output unit 44. With this structure, the processing unit 41 is able to read information stored in the memory unit 42, write information in the memory unit 42, receives information from the input unit 43, and output information to the output unit 44.

The memory unit 42 stores a computer program for controlling the operation of the work machine 5 and information for controlling the operation of the work machine 5. In the present embodiment, the memory unit 42 stores a computer program for realizing a work vehicle control method according to the present embodiment. The processing unit 41 reads the computer program from the memory unit 42 and executes it to thereby implement the work vehicle control method according to the present embodiment.

The input unit 43 is connected with a boom angle detection sensor 46, a bucket angle detection sensor 47, a boom cylinder pressure sensor 48 which detects pressure (bottom pressure) of the hydraulic oil filling the boom cylinder 9, the TM control device 49 which controls the transmission 64, a vehicle speed sensor 50, the engine control device 51 which controls the engine 60, a first potentiometer 31, and a second potentiometer 33. The processing unit 41 obtains detection values or command values thereof, and controls the operation of the work machine 5.

In the present embodiment, a stroke of the boom cylinder 9 and a stroke of the bucket cylinder 10 are obtained from the angle of the boom 3 detected by the boom angle detection sensor 46 and the angle of the bucket 4 detected by the bucket angle detection sensor 47 or the angle of the bell crank 11. The control device 40 obtains at least one of a stroke of the boom cylinder 9 or a stroke of the bucket cylinder 10 using at least one of the boom angle detection sensor 46 and the bucket angle detection sensor 47 to thereby control the operation of the boom 3 and the bucket 4.

The vehicle speed sensor 50 as a vehicle speed detection device detects a speed (vehicle speed) at which the wheel loader 1 travels. The vehicle speed sensor 50 may obtain the vehicle speed of the wheel loader 1 from the rotational speed of the output shaft of the transmission 64 shown in FIG. 2, for example. The TM control device 49 shifts the gear stage of the transmission 64. In that case, the TM control device 49 controls the gear stage based on the vehicle speed obtained from the vehicle speed sensor 50, the accelerator position of the wheel loader 1, and the like, for example. The engine control device 51 controls the amount of fuel supplied to the engine 60 based on the accelerator position and the engine speed of the engine 60, for example, to thereby control the power of the engine 60. In the present embodiment, a computer can be used for either the TM control device 49 or the engine control device 51.

The output unit 44 is connected with the solenoid command part 21S of the boom lowering electromagnetic proportional control valve 21, the solenoid command part 22S of the boom raising electromagnetic proportional control valve 22, the solenoid command part 23S of the bucket dump electromagnetic proportional control valve 23, the solenoid command part 24S of the bucket tilt electromagnetic proportional control valve 24, and an input/output device 45. The processing unit 41 gives a command value for operating the boom cylinder 9 to the solenoid command part 21S of the boom lowering electromagnetic proportional control valve 21 or the solenoid command part 22S of the boom raising electromagnetic proportional control valve 22 to thereby extend or contract the boom cylinder 9. With extension or contraction of the boom cylinder 9, the boom 3 moves up and down. The processing unit 41 gives a command value for operating the boom cylinder 9 to the solenoid command part 23S of the bucket dump electromagnetic proportional control valve 23 or the solenoid command part 24S of the bucket tilt electromagnetic proportional control valve 24 to thereby extend or contract the bucket cylinder 10. With extension or contraction of the bucket cylinder 10, the bucket 4 performs tilting or dumping. In this way, the processing unit 41 controls operation of the work machine 5, that is, operation of the boom 3 and the bucket 4.

The input/output device 45, connected with both the input unit 43 and the output unit 44, includes an input device 45S, a sound generation device 45B, and a display device 45M. The input/output device 45 is configured to input a command value from the input device 45S to the control device 40, generate an alarm sound from the sound generation device 45B, display a state of the work machine 5 or information relating to the control of the work machine 5 on the display device 45M, and the like. The input device 45S may be a push-button switch, for example. When the input device 45S is operated, information displayed on the display device 45M is switched, or the operation mode of the wheel loader 1 is switched.

The control lever CL as an operation device includes a boom control lever 30 and a bucket control lever 32. The boom control lever 30 is a device for operating the boom 3. The boom control lever 30 is equipped with the first potentiometer 31 which detects the operation amount with respect to the boom control lever 30. The bucket control lever 32 is a device for operating the bucket 4. The bucket control lever 32 is equipped with the second potentiometer 33 which detects the operation amount with respect to the bucket control lever 32. Detection signals of the first potentiometer 31 and the second potentiometer 33 are input to the input unit 43 of the control device 40. A selector lever 18L of the transmission 64 is used for shifting the gear stage of the transmission 64, switching between moving forward and backward, and the like.

<Structure and Operation of Work Machine 5>

Figure 3:
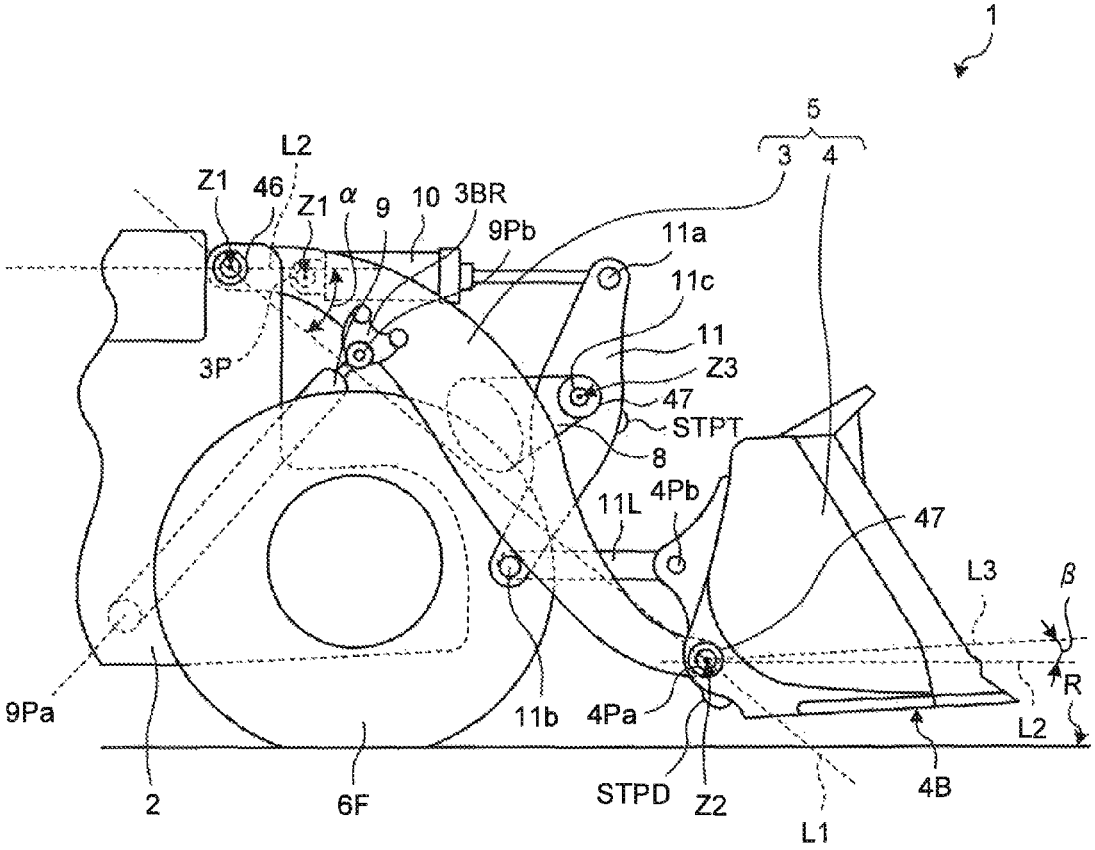
FIG. 3 is a diagram illustrating a work machine.
Figure 4:
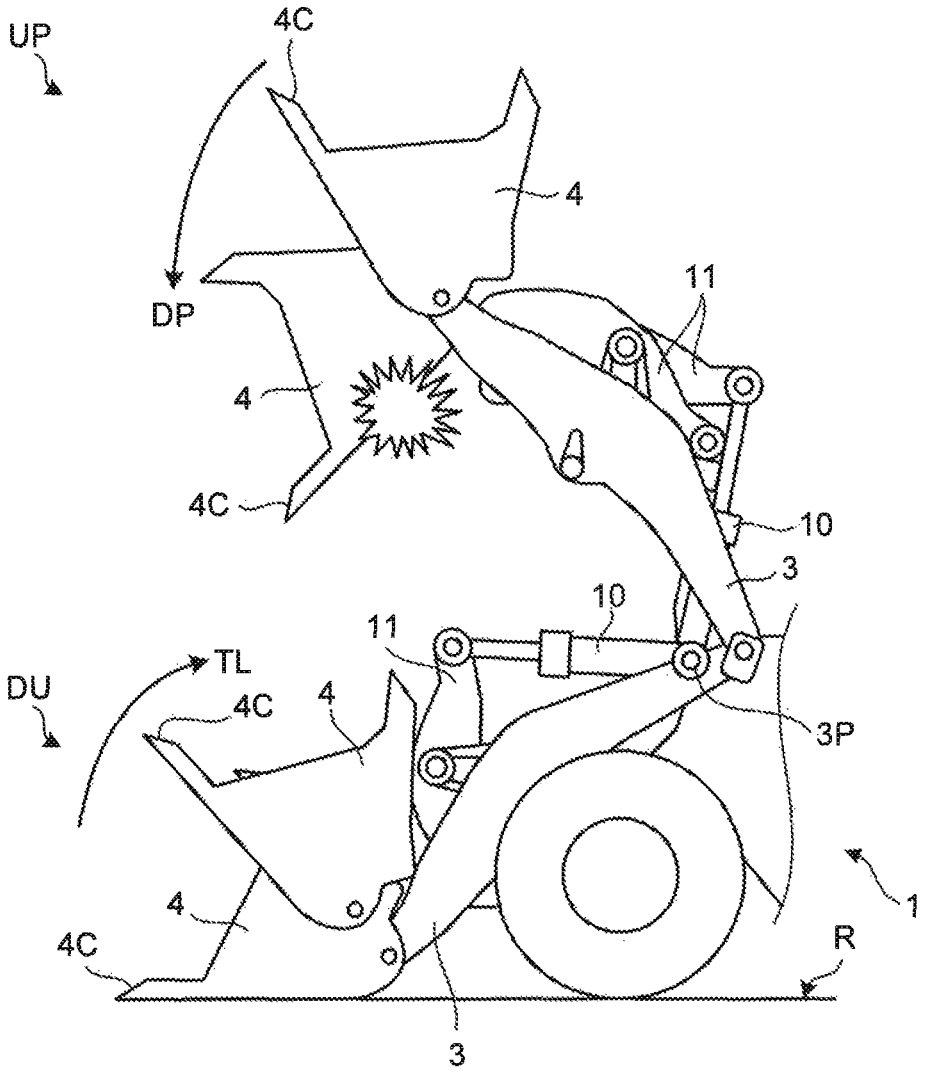
FIG. 4 is a diagram for explaining tilting and dumping of a bucket provided to a wheel loader.

FIG. 3 is a diagram illustrating the work machine 5. FIG. 4 is a diagram for explaining tilting and dumping of the bucket 4 provided to the wheel loader 1. As illustrated in FIG. 3 and FIG. 4, the boom 3 of the work machine 5 is pin-connected, on a first end side thereof, with the vehicle body 2 by a connecting pin 3P. Between the both ends of the boom 3, a bracket 3BR for mounting the boom cylinder 9 is attached. The boom cylinder 9 is mounted such that a first end thereof is pin-connected with the vehicle body 2 by a connecting pin 9Pa, and a second end thereof is pin-connected with the bracket 3BR by a connecting pin 9Pb. With this structure, when the boom cylinder 9 is extended or contracted, the boom 3 turns (moves up and down) about a central axis Z1 of the connecting pin 3P. Specifically, the boom 3 is raised when the boom cylinder 9 is extended, while the boom 3 is lowered when the boom cylinder 9 is contracted.

The bucket 4 is pin-connected with the second end side of the boom 3, that is, an end side opposite to the vehicle body 2 side (an end side away from the vehicle body 2), by a connecting pin 4Pa. With this structure, the bucket 4 turns about a central axis Z2 of the connecting pin 4Pa. The bucket cylinder 10 is configured such that a first end thereof is pin-connected with the vehicle body 2 by the connecting pin 3P, and a second end thereof is pin-connected with a first end of the bell crank 11 by a connecting pin 11*a*. A second end of the bell crank 11 is pin-connected with a first end of a connecting member 11L by a connecting pin 11*b*. A second end of the connecting member 11L is pin-connected with the bucket 4 by a connecting pin 4Pb.

The boom 3 has a support member 8 which supports the bell crank 11, between the both ends. The bell crank 11 is pin-connected, at the part between the both ends, with the support member 8 by a connecting pin 11*c*. With this structure, the bell crank 11 turns about a central axis Z3 of the connecting pin 11*c*. When the bucket cylinder 10 is contracted, the first end of the bell crank 11 moves to the vehicle body 2 side. As the bell crank 11 turns about the central axis Z3 of the connecting pin 11*c*, the second end of the bell crank 11 moves in a direction away from the vehicle body 2. Then, the bucket 4 performs dumping via the connecting member 11L. When the bucket cylinder 10 is extended, the first end of the bell crank 11 moves away from the vehicle body 2 side. Then, as the second end of the bell crank 11 comes close to the vehicle body 2, the bucket 4 performs tilting via the connecting member 11L.

On the second end side of the boom 3, a stopper of the dump side (hereinafter referred to as a dump stopper as appropriate) STPD, which regulates the dumping of the bucket 4, is provided. The dump stopper STPD comes in contact with the bucket 4 to thereby prevent excessive dumping of the bucket 4. The position of the bucket 4, when the bucket 4 is in contact with the dump stopper STPD, is called a dump end. On the side opposite to the bucket 4 of the bell crank 11, a stopper on the tilt side (hereinafter referred to as a tilt stopper as appropriate) STPT, which regulates the tilting of the bucket 4, is provided. The tilt stopper STPT comes in contact with the bucket 4 to thereby prevent excessive tilting of the bucket 4. The position of the bucket 4, when the bucket is in contact with the tilt stopper STPT, is called a tilt end. In the present embodiment, while the dump stopper STPD is used to regulate the dumping of the bucket 4, the present invention is not limited to this. For example, a stroke end of the bucket cylinder 10 may regulates the dumping of the bucket 4, instead of the dump stopper STPD. The bucket 4 is configured such that dumping stops at the stop position on the dump side. In the present embodiment, the stop position on the dump side may be the position of the dump stopper STPD or the position of the stroke end of the bucket cylinder 10, for example.

<Boom Angle α and Bucket Angle β>

In the work machine 5, the angle of the boom 3 (hereinafter referred to as a boom angle) α is a small one of angles between a line L1 linking the central axis Z1 of the connecting pin 3P and the central axis Z2 of the connecting pin 4Pa, and a horizontal line L2 passing through the connecting pin 3P parallel to the grounding surface of the front wheels 6F and the rear wheels 6R. In the present embodiment, the boom angle α becomes negative if the boom 3 is tilted toward a road surface R side from the horizontal line L2. When the boom 3 moves up, the boom angle α increases.

The angle of the bucket 4 (hereinafter referred to as a bucket angle as appropriate) β is an angle between the road surface R (corresponding to the horizontal line L2 in FIG. 3) and a line L3 passing through the central axis Z2 of the connecting pin 4Pa parallel to a bottom surface 4B of the bucket 4. In the present embodiment, the bucket angle β is negative if the front side of the line L3 is directed downward with respect to the central axis Z2 of the connecting pin 4Pa. When the bucket 4 performs tilting, the bucket angle β increases.

The boom angle detection sensor 46 which detects the boom angle α is provided to the part of the connecting pin 3P for pin-connecting the boom 3 with the vehicle body 2. The bucket angle detection sensor 47 which detects the bucket angle β is provided to the part of the connecting pin 11*c*, and indirectly detects the angle of the bucket 4 via the bell crank 11. The bucket angle detection sensor 47 may be provided to the part of the connecting pin 4Pa which connects the boom 3 and the bucket 4. In the present embodiment, while potentiometers are used as the boom angle detection sensor 46 and the bucket angle detection sensor 47, for example, the present invention is not limited to this.

The boom angle α detected by the boom angle detection sensor 46 serves as an index indicating the posture of the boom 3. As such, the boom angle detection sensor 46 works as a boom posture detection device which detects the posture of the boom 3. The bucket angle β detected by the bucket angle detection sensor 47 serves as an index indicating the posture of the bucket 4. As such, the bucket angle detection sensor 47 works as a bucket posture detection device which detects the posture of the bucket 4.

When the operator of the wheel loader 1 operates the boom control lever 30 or the bucket control lever 32, the control device 40 obtains a signal of the operation amount of the boom control lever 30 or the bucket control lever 32 from the first potentiometer 31 or the second potentiometer 33. Then, the control device 40 outputs a work machine speed control command, corresponding to the signal of the operation amount, to the boom lowering electromagnetic proportional control valve 21, the boom raising electromagnetic proportional control valve 22, the bucket dump electromagnetic proportional control valve 23, or the bucket tilt electromagnetic proportional control valve 24.

The boom lowering electromagnetic proportional control valve 21, the boom raising electromagnetic proportional control valve 22, the bucket dump electromagnetic proportional control valve 23, or the bucket tilt electromagnetic proportional control valve 24 outputs a pilot pressure corresponding to the magnitude of the work machine speed control command, to the pilot pressure receiving part of the corresponding boom operation valve 13 or the bucket operation valve 14. Then, the boom cylinder 9 or the bucket cylinder 10 is operated in a corresponding direction at a speed corresponding to the respective pilot oil pressure.

The wheel loader 1 enters into dirt, crushed stones, or the like at a lower position DU illustrated in FIG. 4, that is, a position where the claw 4C of the bucket 4 comes close to the road surface R. At this time, the wheel loader 1 extends the bucket cylinder 10 so as to allow the bucket 4 to perform tilting to thereby scoop dirt, quarried stones, or the like into the bucket 4. Tilting is an operation that the claw 4C of the bucket 4 is separated from the road surface R and moves toward the bell crank 11 side (operation to move in a direction shown by an arrow TL in FIG. 4).

The wheel loader 1 raises the boom 3 to thereby lift the bucket 4 which scooped dirt, quarried stones, or the like to an upper position UP, and load the dirt, crushed stores, or the like on a vessel of the dump truck, for example. When loading the dirt, crushed stones, or the like, the wheel loader 1 contracts the bucket cylinder 10 so as to allow the bucket 4 to perform dumping to thereby cause the claw 4C of the bucket 4 to face downward. Then, the dirt, crushed stones, or the like, held by the bucket 4, is released from the bucket 4 to the vessel. Dumping is an operation that the claw 4C of the bucket 4 moves downward (operation to move in a direction shown by an arrow DP in FIG. 4).

When the bucket 4 performs dumping, the bucket 4 comes in contact with the dump stopper STPD illustrated in FIG. 3. At this time, an impact may be generated. As such, in the present embodiment, control to suppress the impact, as described above, is performed when the bucket 4 performs dumping. Further, when the boom 3 is raised, even though the bucket 4 is not operated, the bucket 4 may be in contact with the dump stopper STPD illustrated in FIG. 3 during rising of the boom 3, depending on the posture of the bell crank 11, the posture of the boom 3, and a state of the length of the bucket cylinder 10. If the boom 3 is raised in such a state, the bucket 4 receives reaction force from the dump stopper STPD. Therefore, in the present embodiment, the bucket 4 is caused to perform tilting automatically if needed, at the time of rising of the boom 3.

<Control in Dumping>

Figure 7:
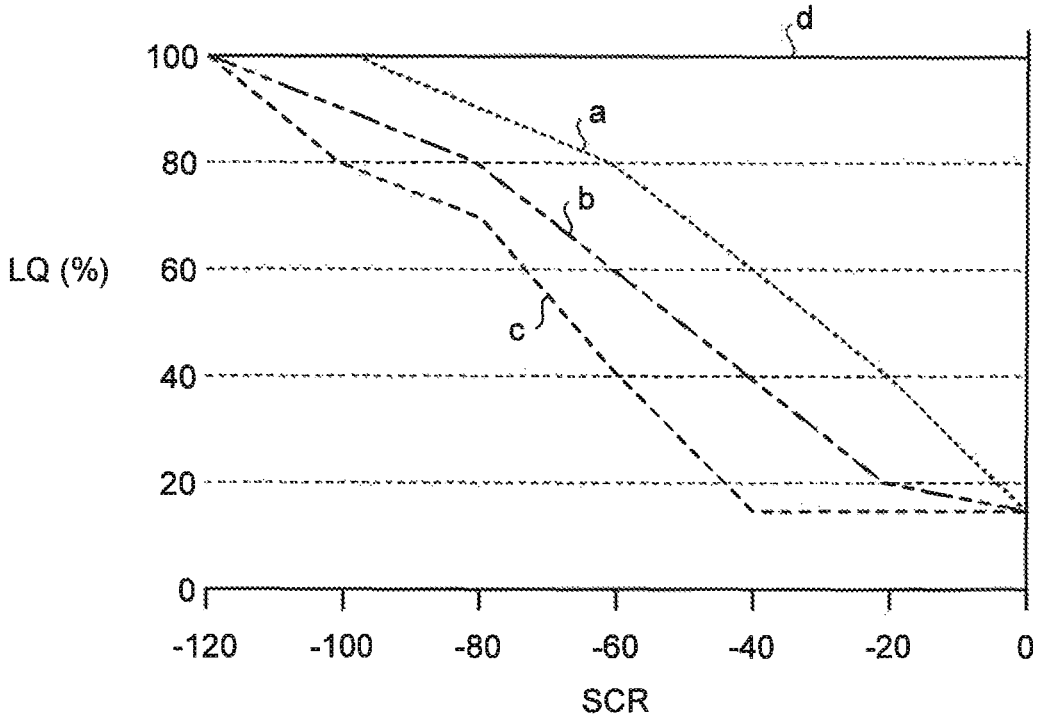
FIG. 7 is a drawing illustrating a relationship between a limit rate of a boom rising speed and a reach distance of a bucket cylinder.

FIG. 5 is a drawing illustrating an example of a first table TBA for control to be used for control at the time of dumping in the work vehicle control method according to the present embodiment. FIG. 6 is a drawing illustrating an example of a second table TBA for control to be used for control at the time of dumping in the work vehicle control method according to the present embodiment. FIG. 7 is a drawing illustrating a relationship between a limit rate LQ of a boom rising speed and a reach distance SCR of the bucket cylinder 10. Reference signs a, b, c, and d in FIG. 5 and FIG. 6 correspond to lines a, b, c, and d in FIG. 7, in this order.

At the time of dumping by the bucket 4, an operating speed when the bucket 4 is operated is limited corresponding to the distance up to a point where the bucket 4 comes in contact with the dump stopper STPD. This control is called dumping impact suppression control, as appropriate. The dumping of the bucket 4 is performed even during rising of the boom 3. In that case, dumping by the bucket 4 is performed as a complex operation with the boom 3. The rising speed of the boom 3 varies depending on the condition of the work site. If the operating speed of the bucket 4 is limited uniformly, suppression of an impact may become insufficient, or the productivity may be lowered. Further, as an operation similar to the dumping, there is a process to turn the bucket 4 upward and downward in turn so as to cause the bucket 4 to bump into the dump stopper STPD to thereby drop the mud or the like (hereinafter referred to as mud dropping, as appropriate) attached to the bucket 4. If the operating speed, when the bucket 4 is operated, is limited by the dumping impact suppression control, an impact when the bucket 4 bumps into the dump stopper STPD is suppressed. Consequently, the mud dropping process may be insufficient, or mud dropping process may take time.

The control device 40 illustrated in FIG. 2 is configured such that at the time of dumping by the bucket 4, the control device 40 performs the dumping impact suppression control according to the work vehicle control method of the present embodiment, to thereby suppress an impact generated at the time of dumping by the bucket 4, and operate the bucket 4 according to the intention of the operator. In the present embodiment, when the bucket 4 performs dumping, the control device 40 obtains a operable amount that the bucket cylinder 10 is able to operate before the bucket 4 reaches the dump stopper STPD based on the posture of the boom 3 and the posture of the bucket 4, and the operation amount for raising the boom 3 or the rising speed of the boom 3. Then, the control device 40 limits the operating speed of the bucket cylinder 10 according to the operable amount that the bucket cylinder 10 is able to operate before the bucket 4 reaches the dump stopper STPD, and based on the obtained operation amount for raising the boom 3 or the rising speed of the boom 3, changes the limit amount of the operating speed of the bucket cylinder 10.

The operable amount of the bucket cylinder 10 before the bucket 4 reaches the dump stopper STPD is represented by a distance up to a position where the bucket 4 reaches the dump stopper STPD (hereinafter referred to as a reach distance as appropriate). If the reach distance is represented as SCR, it is a value calculated by subtracting the current length (entire length) of the bucket cylinder 10, from a length (entire length) of the bucket cylinder 10 when the bucket 4 reaches the dump stopper STPD at a boom angle $\alpha$.

As the positional relationship among the boom 3, the bell crank 11, and the bucket 4 is changed according to the boom angle $\alpha$, the reach distance SCR is also changed according to the boom angle $\alpha$. In the present embodiment, the memory unit 42 of the control device 40 illustrated in FIG. 2 stores the length of the bucket cylinder 10 when the bucket 4 reaches the dump stopper STPD (hereinafter referred to as a length when reached), which is calculated for each of a plurality of boom angles $\alpha$, for example. When calculating the reach distance SCR, the processing unit 41 of the control device 40 obtains the boom angle $\alpha$ and the bucket angle $\beta$ or the angle of the bell crank 11 at the current point from the boom angle detection sensor 46 and the bucket angle detection sensor 47 illustrated in FIG. 2 and FIG. 3, and calculates the length of the bucket cylinder at the current point. Then, the processing unit 41 obtains the length when reached corresponding to the obtained boom angle α, and subtracts the length of the bucket cylinder at the current point, from the obtained length when reached. In this way, the processing unit 41 is able to calculate the reach distance SCR.

The first table TBA illustrated in FIG. 5 and the second table TBB illustrated in FIG. 6 describe the limit rate LQ for determining the limit amount of the operating speed of the bucket cylinder 10, to be used for control at the time of dumping by the bucket 4. The first table TBA and the second table TBB illustrated in FIG. 6 describe the limit rate LQ with respect to the reach distance SCR, for each operation amount BVC of an operation to raise the boom 3 (hereinafter referred to as boom raising as appropriate). At the time of dumping, as the bucket cylinder 10 is contracted, the reach distance SCR is represented by a negative sign, as illustrated in FIG. 5 and FIG. 6. As the absolute value of the reach distance SCR becomes smaller, the distance up to a point where the bucket 4 reaches the dump stopper STPD becomes shorter. When the reach distance SCR is zero, the bucket 4 reaches the dump stopper STPD.

The operation amount for raising the boom (hereinafter referred to as a boom raising operation amount as appropriate) BVC is an operation amount of the boom control lever 30 illustrated in FIG. 2. When the boom raising operation amount BVC increases, the flow rate of the hydraulic oil supplied to the boom cylinder 9 illustrated in FIG. 1 and FIG. 2 increases. Consequently, the rising speed of the boom 3 increases. The boom raising operation amount BVC is 100% when the operation amount of the boom control lever 30 at the time of raising the boom 3 is maximum, and is 0% when the boom control lever 30 is neutral. In the first table TBA and the second table TBB, while the reach distance SCR is described for each of the three stages where the boom raising operation amount BVC is 0%, 50%, and 100%, for a case where the boom raising operation amount BVC is between 0% and 50% and between 50% and 100%, the limit rate LQ can be obtained by interpolation, for example.

The operating speed of the bucket cylinder 10 varies according to the flow rate of the hydraulic oil supplied to the bucket cylinder 10. In the present embodiment, the operating speed of the bucket cylinder 10 is limited by limiting the target flow rate of the hydraulic oil supplied to the bucket cylinder 10 at the time of dumping (hereinafter referred to as dump time target flow rate as appropriate). The dump time target flow rate is determined by the operation amount of the bucket control lever 32 illustrated in FIG. 2.

If the dump time target flow rate is represented as QTd, and the operation amount of the bucket control lever 32 at the time of dumping (hereinafter referred to as bucket dump operation amount, as appropriate) is represented as QBKd, as the bucket dump operation amount QBKd increases, the dump time target flow rate QTd also increases, and consequently, the speed at the time of dumping by the bucket 4 also becomes higher. The bucket dump operation amount QBKd is 100% when the operation amount of the bucket control lever 32 for causing the bucket 4 to dump is maximum, and is 0% when the bucket control lever 32 is neutral.

In the present embodiment, at the time of dumping, the control device 40 controls the operation of the bucket cylinder 10 using a corrected dump time target flow rate QTdc calculated by multiplying the dump time target flow rate QTd, determined by the bucket dump operation amount QBKd, by the limit rate LQ. Consequently, the operating speed of the bucket cylinder 10 becomes smaller compared with the case before it is limited by the limit rate LQ.

The limit rates LQ described in the first table TBA illustrated in FIG. 5 and the second table TBB illustrated in FIG. 6 are expressed in percentages. For example, when the limit rate LQ is 100%, the corrected dump time target flow rate QTdc equals to the dump time target flow rate QTd, and when the limit rate LQ is 60%, the corrected dump time target flow rate QTdc becomes 60% of the dump time target flow rate QTd. When the limit rate LQ is 15%, the corrected dump time target flow rate QTdc becomes 15% of the dump time target flow rate QTd. Accordingly, as the limit rate LQ is smaller, the degree that the corrected dump time target flow rate QTdc becomes smaller than the dump time target flow rate QTd is larger. Thus, as the limit rate LQ is smaller, the limit amount of the operating speed of the bucket cylinder 10 becomes larger.

Regarding the first table TBA in FIG. 5 and the second table TBB in FIG. 6, either one is used based on the operable amount that the bucket cylinder 10 is able to operate before the bucket 4 reaches the dump stopper STPD (hereinafter referred to as operating time operable amount, as appropriate) when the condition for executing the dumping impact suppression control is satisfied. If the operating time operable amount is represented as SCRm, in the case where the operating time operable amount SCRm is a predetermined value SCRc or larger, the first table TBA is used for the dumping impact suppression control, while in the case where the operating time operable amount SCRm is smaller than the predetermined value SCRc, the second table TBB is used for the dumping impact suppression control.

If the boom raising operation amount BVC in the first table TBA illustrated in FIG. 5 is 0%, the limit rate LQ varies as a line "a" illustrated in FIG. 7 according to the change of the reach distance SCR. If the boom raising operation amount BVC in the second table TBB illustrated in FIG. 6 is 0%, the limit rate LQ varies as a line "d" illustrated in FIG. 7 according to the change of the reach distance SCR. If the boom raising operation amount BVC in the first table TBA and the second table TBB is 50%, the limit rate LQ varies as a line "b" illustrated in FIG. 7 according to the change of the reach distance SCR. If the boom raising operation amount BVC in the first table TBA and the second table TBB is 100%, the limit rate LQ varies as a line "c" illustrated in FIG. 7 according to the change of the reach distance SCR.

In the first table TBA, the limit rate LQ becomes smaller as the reach distance SCR becomes shorter, that is, the distance up to a point where the bucket 4 reaches the dump stopper STPD becomes shorter. This means that as the bucket 4 comes closer to the dump stopper STPD, the limit amount of the operating speed of the actuator becomes larger, and the operating speed of the bucket cylinder 10 becomes lower.

In the second table TBB, when the boom raising operation amount BVC is not zero (0%), as the limit rate LQ becomes smaller as the reach distance SCR becomes shorter, the limit amount of the operating speed of the actuator becomes larger, and the operating speed of the bucket cylinder 10 becomes lower. The boom 3 is raised when the boom raising operation amount BVC is not zero (0%), and the boom 3 stops when the boom raising operation amount BVC is zero (0%).

In the first table TBA and the second table TBB, as the bucket 4 comes closer to the dump stopper STPD, the operating speed of the bucket cylinder 10 becomes lower. As such, by executing the dumping impact suppression control using the first table TBA and the second table TBB, the control device 40 is able to suppress an impact at the dump end when the bucket 4 comes in contact with the dump stopper STPD.

When the boom raising operation amount BVC is zero (0%), that is, when the boom 3 has stopped, in the second table TBB, the limit rate LQ is 100% regardless of the reach distance SCR. As such, when the boom raising operation amount BVC is zero (0%), the limit amount of the operating speed of the bucket cylinder 10 is zero, whereby hydraulic oil is supplied to the bucket cylinder 10 at the dump time target flow rate QTd determined according to the bucket dump operation amount QBKd. Consequently, the operating speed of the bucket cylinder 10 is not limited, and the operating speed corresponding to the operation of the bucket control lever 32 by the operator is realized.

In the first table TBA and the second table TBB, if the reach distance SCR is the same, when the boom raising operation amount BVC is changed from 100% to 0%, the limit rate LQ becomes larger, and when the boom raising operation amount BVC is changed from 0% to 100%, the limit rate LQ becomes smaller. This means that in the first table TBA and the second table TBB, the limit amount of the operating speed of the bucket cylinder 10 is changed to be larger if the boom raising operation amount BVC is larger or the rising speed of the boom 3 is higher, and is changed to be smaller if the boom raising operation amount BVC is smaller or the rising speed of the boom is lower.

If the bucket 4 comes in contact with the dump stopper STPD when the rising speed of the boom 3 is higher, an impact is larger, compared with the case where the bucket 4 comes in contact with the dump stopper STPD when the rising speed of the boom 3 is lower. Further, if the boom 3 is raised when the bucket 4 comes in contact with the dump stopper STPD, an impact may be caused at the dump end at the time of tilting of the bucket 4 or an operation to lower the boom 3, due to the hydraulic oil in the bucket cylinder 10 being pressurized. Such an impact is more remarkable as the rising speed of the boom 3 is higher.

According to the first table TBA and the second table TBB, by allowing the limit amount of the operating speed of the bucket cylinder 10 to be larger as the boom raising operation amount BVC or the rising speed of the boom 3 is larger, it is possible to suppress an impact to be caused when the bucket 4 comes in contact with the dump stopper STPD during rising of the boom 3. Further, according to the first table TBA and the second table TBB, it is possible to suppress an impact to be caused at a dump end at the time of tilting of the bucket 4 or at the time of operation to lower the boom 3, due to the hydraulic oil in the bucket cylinder 10 being pressurized.

In the present embodiment, as the limit amount of the operating speed of the bucket cylinder 10 is changed based on the boom raising operation amount BVC or the rising speed of the boom 3, the reduction amount of the operating speed of the bucket 4 is also changed. As such, the operating speed of the bucket 4 can be faster, compared with the case where the operating speed of the bucket cylinder 10 is limited uniformly in the dumping impact suppression control. In this way, as operation delay of the bucket 4 with respect to the bucket control lever 32 performed by the operator can be suppressed, a sense of discomfort felt by the operator can be suppressed, and a reduction in productivity can also be prevented.

In the present embodiment, the control device 40 performs the dumping impact suppression control by using the second table TBA if the operating time operable amount SCRm is less than the predetermined value SCRc. If the bucket 4 performs dumping in a state where the operating time operable amount SCRm is less than the predetermined value SCRc and the boom raising operation amount BVC or the rising speed of the boom 3 is zero, it can be determined that the mud dropping, described above, is performed. For example, if the remaining length of the bucket cylinder 10, up to the point where the bucket 4 comes in contact with the dump stopper STPD, is about 100 mm, as it can be determined that mud dropping is performed, it can be set to 100 mm. As such, while the predetermined value SCRc may be set to 100 mm, for example, the present invention is not limited to this.

If the boom raising operation amount BVC or the rising speed of the boom 3 is zero, in the second table TBB, as the limit rate LQ is 100% regardless of the reach distance SCR as described above, the operating speed of the bucket cylinder 10 is not limited, and the bucket 4 is operated at an operating speed corresponding to the operation of the bucket control lever 32 by the operator. As such, the control device 40 releases the limit on the moving speed of the bucket cylinder 10. In this way, if it is determined that mud dropping is performed, as the control device 40 does not limit the operating speed of the bucket cylinder 10, it is possible to cause the bucket 4 to bump into the dump stopper STPD vigorously to thereby drop the mud from the bucket 4 speedy and reliably.

<Exemplary Control>

Figure 8:
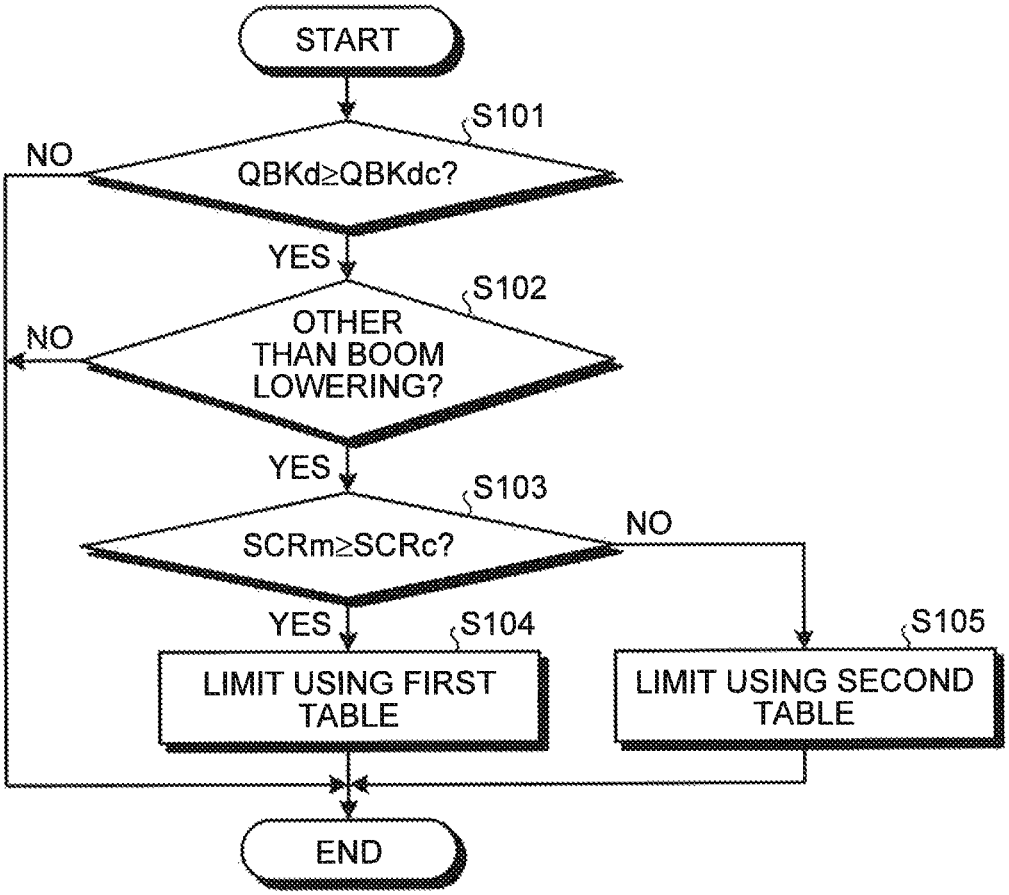
FIG. 8 is a flowchart illustrating an example of control at the time of dumping in the work vehicle control method according to the present embodiment.
Figure 9:
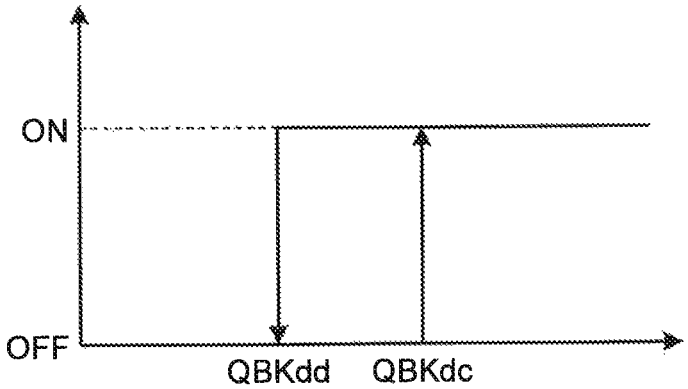
FIG. 9 is a drawing for explaining determination to start and stop control at the time of dumping.

FIG. 8 is a flowchart illustrating exemplary control at the time of dumping in the work vehicle control method according to the present embodiment. FIG. 9 is a drawing for explaining determination to start and stop control at the time of dumping. When performing control at the time of dumping of the bucket 4, at step S101, the control device 40 illustrated in FIG. 2 compares the bucket dump operation amount QBKd and a bucket dump operation amount threshold QBKdc. The bucket dump operation amount threshold QBKdc is a value larger than 0% and smaller than 100%. In the present embodiment, it is 30%, for example. The bucket dump operation amount threshold QBKdc is not limited to 30%.

If the bucket dump operation amount QBKd is the bucket dump operation amount threshold QBKdc or larger (step S101, Yes), the process proceeds to step S102, and the control device 40 determines whether or not the operation of the boom 3 is an operation other than the boom lowering operation. An operation other than the boom lowering operation means either rising of the boom 3 or a stop of the boom 3. If the operation of the boom 3 is other than the boom lowering operation (step S102, Yes), the process proceeds to step S103, and the control device 40 compares the operating time operable amount SCRm and a predetermined value SCRc. In that case, the control device 40 obtains the operating time operable amount SCRm based on the posture of the boom 3 and the posture of the bucket 4 at the time when an operation to cause the bucket 4 to perform dumping is started with respect to the bucket control lever 32 for operating the bucket 4.

If the operating time operable amount SCRm is the predetermined value SCRc or larger (step S103, Yes), the process proceeds to step S104, and the control device 40 uses the first table TBA to perform dumping impact suppression control. If the operating time operable amount SCRm is smaller than the predetermined value SCRc (step S103 No), the process proceeds to step S105, and the control device 40 uses the second table TBB to perform control in dumping. In that case, as it is determined that mud dropping is performed, the control device 40 does not perform dumping impact suppression control, and the hydraulic oil is supplied to the bucket cylinder 10 so as to realize the dump time target flow rate calculated from the operation amount of the bucket control lever 32. When step S104 and S105 end, the control device 40 goes back to the start and performs the process after step S101.

At step S101, if the bucket dump operation amount QBKd is less than the bucket dump operation amount threshold QBKdc (step S101, No), the control device 40 does not perform dumping impact suppression control, and goes back to the start and performs the process after step S101.

In the present embodiment, the control device 40 performs dumping impact suppression control if the bucket dump operation amount QBKd is the bucket dump operation amount threshold QBKdc or larger, which is one of the conditions. In the dumping impact suppression control, if the operator operates the bucket control lever 32 and the bucket dump operation amount QBKd becomes less than the bucket dump operation amount threshold QBKdc (step S101), the dumping impact suppression control is not performed. If an input is given to the bucket control lever 32 by which the bucket dump operation amount QBKd becomes close to the bucket dump operation amount threshold QBKdc, there is a possibility of occurrence of a hunting phenomenon in which execution and suppression of the dumping impact suppression control is performed in turn.

As such, as illustrated in FIG. 9, a condition that the bucket dump operation amount QBKd becomes the bucket dump operation amount threshold QBKdc or larger may be required for starting the dumping impact suppression control, while a condition that the bucket dump operation amount QBKd becomes a suspension determination threshold QBKdd or smaller may be required for suspending the dumping impact suppression control. The suspension determination threshold QBKdd is smaller than the bucket dump operation amount threshold QBKdc. In this way, the above-described hunting can be prevented.

If the bucket dump operation amount QBKd is small, even if the bucket 4 performs dumping to thereby come in contact with the dump stopper STPD, the operating speed of the bucket 4 is small, so that an impact is also small. If an impact when the bucket 4 comes in contact with the dump stopper STPD has a magnitude which is of an allowable level, it is possible to improve the productivity and operability by not performing the dumping impact suppression control. In the present embodiment, a condition that the bucket dump operation amount QBKd becomes the bucket dump operation amount threshold QBKdc or larger is taken as a condition for starting the dumping impact suppression control. With this configuration, if the bucket dump operation amount QBKd has a magnitude in which an impact when the bucket 4 comes in contact with the dump stopper STPD is in an allowable level, it is possible to improve the productivity and operability by not performing the dumping impact suppression control.

<Control for Automatic Tilting>

Figures 10, 11:
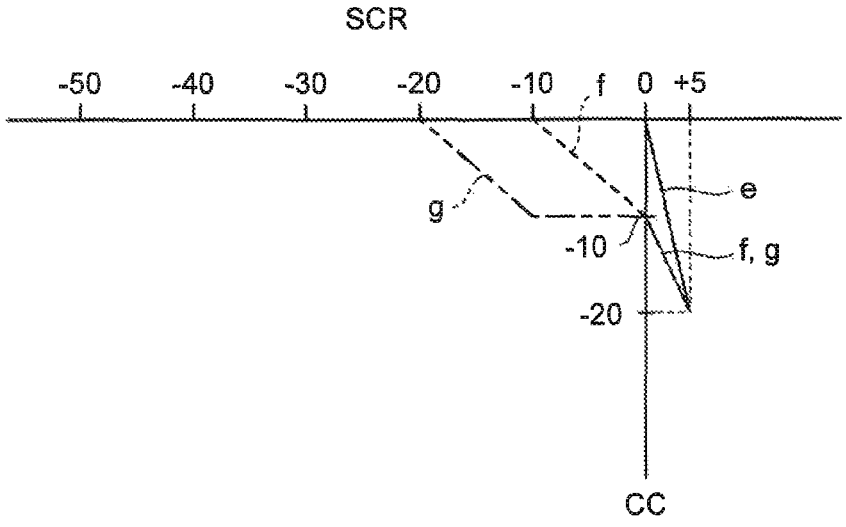
FIG. 10 is a drawing illustrating an example of an automatic tilt table to be used for control when a bucket is caused to perform tilting automatically in the work vehicle control method according to the present embodiment.
FIG. 11 is a drawing illustrating a relationship between a tilt command and a reach distance of a bucket cylinder.

FIG. 10 is a drawing illustrating an example of an automatic tilt table TBC to be used for control when the bucket is caused to perform tilting automatically in the work vehicle control method according to the present embodiment. FIG. 11 is a diagram illustrating the relationship between a tilt command CC and the reach distance SCR of the bucket cylinder 10.

In the wheel loader 1 illustrated in FIG. 1, the length of the bucket cylinder 10 is constant when the bucket 4 is not operated at all, that is, when the operation of the bucket 4 is stopped. As such, if the boom 3 is raised when the bucket 4 is stopped, the positional relation between the bucket 4 and the boom 3 is changed along with rising of the boom 3, whereby the bucket 4 may come in contact with the dump stopper STPD illustrated in FIG. 3. If the bucket 4 comes in contact with the dump stopper STPD when the boom 3 is being raised in a state where the bucket 4 is not operated, excessive loads may be acted on the link mechanism of the work machine 5, the bucket cylinder 10, the boom cylinder 9, and the like.

As such, if the bucket control lever 32 is neutral, that is, if the operation amount of the bucket control lever 32 is zero (0%), when the boom 3 is raised, the control device 40 illustrated in FIG. 2 performs control to cause the bucket 4 to perform tilting automatically. This control is called automatic tilt. The automatic tilt is performed when the bucket 4 is stopped, that is, in the case where the bucket control lever 32 is neutral. With the automatic tilt, the loads placed on the link mechanism of the work machine 5, the bucket cylinder 10, the boom cylinder 9, and the like are reduced. When the bucket 4 performs tilting, the bucket cylinder 10 is contracted.

The automatic tilt is performed in a state where the bucket 4 is stopped, that is, in a state where the operator does not operate the bucket control lever 32. When the automatic tilt is performed, as the bucket 4 is operated automatically, the operator may recognize that unintentional operation of the bucket 4 is caused and feel a sense of discomfort. As such, it is preferable that the operation of the bucket 4 in the automatic tilt should be kept to a requisite minimum. In order to keep the operation of the bucket 4 to a requisite minimum in the automatic tilt, it is only necessary that the length of the bucket cylinder 10 equals to the length when the bucket 4 comes in contact with the dump stopper STPD. The control device 40 illustrated in FIG. 2 makes the operation of the bucket 4 a requisite minimum by performing the automatic tilt by the work vehicle control method according to the present embodiment.

The automatic tilt table TBC illustrated in FIG. 10 describes the relationship between the tilt command CC and the reach distance SCR of the bucket cylinder 10, for each boom raising operation amount BVC. Reference signs e, f, and g in FIG. 10 correspond to lines e, f, and g in FIG. 11, in this order. In the automatic tilt table TBC, while the reach distance SCR is described with respect to each of the three stages where the boom raising operation amount BVC is 0%, 50%, and 100%, for the boom raising operation amount BVC between 0% and 50% and between 50% and 100%, the tilt command CC can be obtained by interpolation, for example.

If the boom raising operation amount BVC in the automatic tilt table TBC is 0%, the tilt command CC varies as a line "e" illustrated in FIG. 11, in accordance with the change of the reach distance SCR. If the boom raising operation amount BVC in the automatic tilt table TBC is 50%, the tilt command CC varies as a line "f" illustrated in FIG. 11, in accordance with the change of the reach distance SCR. If the boom raising operation amount BVC in the automatic tilt table TBC is 100%, the tilt command CC varies as a line "g" illustrated in FIG. 11, in accordance with the change of the reach distance SCR.

The tilt command CC is a command to cause the bucket 4 to perform tilting, and is a command to change the operation amount of the bucket cylinder 10. Specifically, the operating speed of the bucket cylinder 10 is changed by the tilt command CC. For example, if the tilt command CC is −10, the bucket cylinder 10 is extended at an operating speed corresponding to the tilt command CC. The tilt command CC is configured such that as the absolute value thereof is larger, the operation amount of the bucket cylinder 10 to cause the bucket 4 to perform tilting, that is, an operating speed in the present embodiment, is larger.

The automatic tilt table TBC is configured such that as the absolute value of the reach distance SCR of the bucket cylinder 10 is smaller, that is, as the bucket 4 comes closer to the dump stopper STPD, the tilt command CC is larger. Further, the automatic tilt table TBC is configured such that the tilt command CC is given when the boom raising operation amount BVC is larger than 0%. At the time of automatic tilt, the control device 40 illustrated in FIG. 2 changes the tilt command CC based on the boom raising operation amount BVC or the rising speed of the boom 3 to thereby change the operation amount of the bucket cylinder 10 for making the bucket 4 tilt, and cause the bucket 4 to perform tilting corresponding to the reach distance SCR of the bucket cylinder 10. With this configuration, a contact between the bucket 4 and the dump stopper STPD is prevented during rising of the boom 3.

If the rising speed of the boom 3 is higher, as the bucket 4 comes in contact with the dump stopper STPD faster than the case where the rising speed of the boom 3 is lower, even if the automatic tilt is performed, there is a possibility that a pressure contact between the bucket 4 and the dump stopper STPD occurs. In the present embodiment, the automatic tilt table TBC is configured such that as the boom raising operation amount BVC is larger or the rising speed of the boom 3 is higher, the bucket cylinder 10 is caused to be operated from a position where the reach distance SCR is large so as to cause the bucket 4 to perform tilting. As such, if the boom raising operation amount BVC is large or the rising speed of the boom 3 is high, as the bucket 4 performs tilting automatically at earlier timing, a pressure contact between the bucket 4 and the dump stopper STPD can be prevented reliably.

In the automatic tilt, the control device 40 sets zero to the tilt command CC when the reach distance SCR is zero to thereby stop tilting of the bucket 4. In the automatic tilt table TBC, if the boom raising operation amount BVC is 0% or the rising speed of the boom 3 is zero, the tilt command CC is zero when the reach distance SCR is zero. However, if the boom raising operation amount BVC is 50% or 100%, the tilt command CC is −10. As such, if the boom raising operation amount BVC is 50% or 100%, even if the reach distance SCR is zero, the bucket 4 performs tilting. With this configuration, when the boom raising operation amount BVC becomes 0% or the rising speed of the boom 3 becomes zero during rising of the boom 3, the control device 40 is able to stop the bucket 4 at a target position, that is, a position closer to a position where the bucket 4 comes in contact with the dump stopper STPD. Consequently, the control device 40 is able to keep the operation of the bucket 4 in the automatic tilt to be a requisite minimum. Thereby, it is possible to reduce a sense of discomfort given to the operator.

If the boom raising operation amount BVC is larger than 0%, when the boom 3 is raised, there is a possibility that intervention and non-intervention of automatic tilt may be repeated near the area where the bucket 4 and the dump stopper STPD contact with each other. In order to avoid this case, the automatic tilt table TBC is configured such that if the boom raising operation amount BVC is larger than 0%, a value other than zero (−10 in the present embodiment) is set to the tilt command CC, to thereby reduce the possibility that intervention and non-intervention of automatic tilt are repeated. Consequently, a sense of discomfort given to the operator in automatic tilt can be further reduced.

Figure 12:
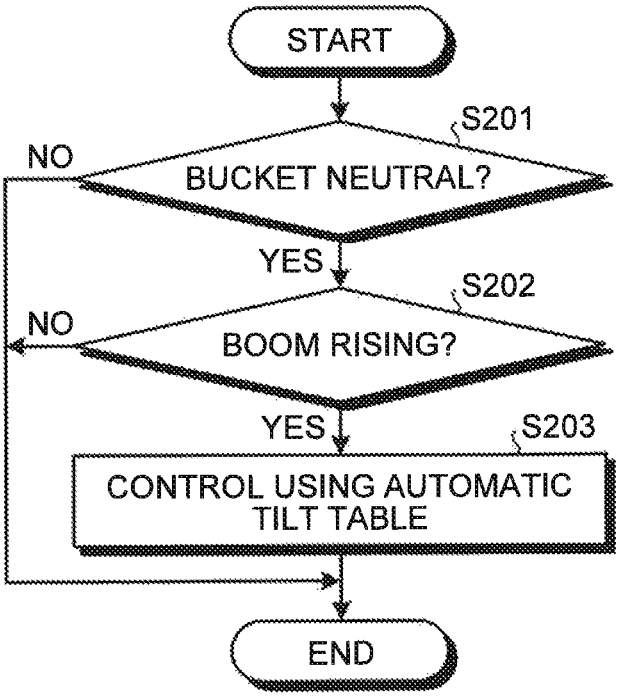
FIG. 12 is a flowchart illustrating exemplary control at the time of automatic tilting in the work vehicle control method according to the present embodiment.

FIG. 12 is a flowchart illustrating exemplary control at the time of automatic tilting in the work vehicle control method according to the present embodiment. In the work vehicle control method according to the present embodiment, when executing automatic tilting of the bucket 4, at step S201, the control device 40 illustrated in FIG. 2 determines that the bucket 4 is neutral, that is, the bucket 4 is not operated. If the bucket control lever 32 illustrated in FIG. 2 is neutral, the bucket 4 is neutral. The control device 40 determines whether or not the bucket control lever 32 is in a neutral state from the detection value of the second potentiometer 33 illustrated in FIG. 2.

If the bucket 4 is neutral (step S201, Yes), the process proceeds to step S202, and the control device 40 determines the boom raising operation, that is, whether or not the boom 3 is being raised or stopped. The control device 40 determines that the boom 3 is being raised or stopped if the boom raising operation amount BVC is 0% or larger. If the boom 3 is being raised (step S202, Yes), at step S203, the control device 40 performs automatic tilting by using the automatic tilt table TBC. If the bucket 4 is not neutral (step S201, No) and the boom 3 is not being raised or stopped (step S202, No), the control device 40 goes back to the start and performs the process after step S101. If the boom 3 is not being raised or stopped, it means the boom 3 is being lowered.

While the present embodiment has been described above, the present embodiment is not limited to that described above. Further, the above-described constituent elements include elements which are easily expected by those skilled in the art, which are substantially the same, and which are in the so-called equal scope. Further, the above-described constituent elements can be combined appropriately. Further, at least one of omission, replacement, and modification of various types of the constituent elements can be made within the scope without departing from the substance of the present embodiment.

REFERENCE SIGNS LIST

1 wheel loader
2 vehicle body
3 boom
4 bucket
4C claw
5 work machine
7 driver's cabin
9 boom cylinder
10 bucket cylinder
11 bell crank
12 work machine hydraulic pump
20 electromagnetic proportional control valve
23 bucket dump electromagnetic proportional control valve
24 bucket tilt electromagnetic proportional control valve
30 boom control lever
32 bucket control lever
40 control device
41 processing unit
42 memory unit
46 boom angle detection sensor
47 bucket angle detection sensor
60 engine
BVC operation amount
CC tilt command CS control system
LQ limit rate
QBKd bucket dump operation amount
QBKdc bucket dump operation amount threshold
QBKdd suspension determination threshold
QTd dump time target flow rate
QTdc corrected dump time target flow rate
SCR reach distance
SCRc predetermined value
SCRm operable amount (operating time operable amount)
STPD dump stopper
STPT tilt stopper
TBA first table
TBB second table
TBC tilt table

The invention claimed is:

1. A method to control a work vehicle, having a boom supported by a vehicle body and configured to turn; and a bucket supported by a side of the boom and configured to turn according to an operation of an actuator, the method comprising:

obtaining an operation amount for raising the boom or a rising speed of the boom and an operable amount that the actuator is able to operate before the bucket reaches a stop position on a dump side, the operable amount being obtained based on a posture of the boom and a posture of the bucket; and causing the bucket to perform tilting by operating the actuator from a position where the operable amount is large such that the operable amount becomes larger as the operation amount for raising the boom is larger or the rising speed of the boom is higher.

2. The method to control a work vehicle according to claim 1, further comprising in a case where the boom is raised and a device for operating the bucket is in a neutral state, causing the bucket to perform tilting according to the operable amount.

3. A work vehicle including a boom supported by a vehicle body and configured to turn; a bucket supported by a side of the boom, and configured to turn according to an operation of an actuator, and a work vehicle control device that controls the actuator, wherein the work vehicle control device obtains an operation amount for raising the boom or a rising speed of the boom, and an operable amount that the actuator is able to operate before the bucket reaches a stop position on a dump side, the operable amount being obtained based on a posture of the boom and a posture of the bucket, and the work vehicle control device causes the bucket to perform tilting by operating the actuator from a position where the operable amount is large such that the operable amount becomes larger as the operation amount for raising the boom is larger or the rising speed of the boom is higher.

4. The work vehicle according to claim 3, wherein in a case where the boom is raised and a device for operating the bucket is in a neutral state, the work vehicle control device causes the bucket to perform tilting according to the operable amount.

5. A work vehicle comprising:

a boom supported by a vehicle body and configured to turn;

a bucket supported by a side, away from the vehicle body, of the boom, and configured to turn according to an operation of an actuator; and the work vehicle control device according to claim 3.

* * * * *